US005127866A

United States Patent [19]

Adler et al.

[11] Patent Number: 5,127,866

[45] Date of Patent: Jul. 7, 1992

[54] MECHANICALLY INDEXED MASK STRETCHING APPARATUS

[75] Inventors: Robert Adler, Northfield; Charles J. Prazak, III, Elmhurst; Johann Steiner, Des Plaines, all of Ill.

[73] Assignee: Zenith Electronics Corporation, Glenview, Ill.

[21] Appl. No.: 605,047

[22] Filed: Oct. 29, 1990

[51] Int. Cl.[5] ..... H01J 9/20; H01J 9/00

[52] U.S. Cl. ..... 445/68; 29/448; 269/34

[58] Field of Search ..... 445/30, 68; 269/34, 269/58, 61, 111, 113, 114; 226/162; 73/833; 254/1; 227/13; 29/448

[56] References Cited

U.S. PATENT DOCUMENTS

| | | | |
|---|---|---|---|
| 3,331,242 | 7/1967 | Schwarz et al. | 73/833 X |
| 3,579,718 | 5/1969 | Miller et al. | 38/102.5 X |
| 4,382,343 | 5/1983 | Chahanian | 227/13 X |
| 4,558,809 | 12/1985 | Schoen | 226/162 |

*Primary Examiner*—Kenneth J. Ramsey

[57] ABSTRACT

Method and apparatus are disclosed for tensioning uniform foil shadow masks by clamping the edges of a mask and moving the clamps through a preselected fixed displacement, thereby obviating the need for extensive controls on the tensioning process.

21 Claims, 5 Drawing Sheets

MECHANICALLY INDEXED MASK STRETCHING APPARATUS

BACKGROUND OF THE INVENTION

1. Field of the Invention

The present invention relates to tensioned shadow masks for color cathode ray tubes. More specifically, the present invention relates to methods and apparatuses for producing interchangeable shadow masks by tensioning the masks by stretching them to a fixed displacement.

2. Discussion of the Related Art

U.S. Pat. No. 4,902,257, ('257), issued Feb. 20, 1990, and assigned to the same assignee as the present invention, describes apparatus and process for manufacturing color cathode ray tubes of the flat tension mask type wherein shadow masks and front panels are respectively interchangeable during mask-panel assembly. According to the cited patent, position sensing means and a feedback control system are provided for applying controlled forces at a plurality of locations about the periphery of the mask, for the purpose of moving the mask to a desired position and stretching it to a desired size and shape for registration and assembly with the screened faceplate.

FIG. 1, corresponding to FIG. 12 of the '257 patent, depicts a prior art machine for applying controlled forces to a plurality of clamps gripping peripheral portions of the flat tension mask. The machine carries optical markers which cooperate with position-sensing apertures in the mask. It is the task of this machine to apply a distribution of forces to the mask such as to bring all position-sensing apertures in the mask into coincidence with their corresponding optical markers. This is achieved by feeding position error signals to a computer which calculates the required forces and feeds appropriate pulses to the stepping motors. Springs inserted between motors and clamps convert motor displacements into well defined forces.

The '257 patent also points out that if the photoetched masks were all exactly alike in thickness, elastic properties and detailed geometry, the forces to be applied to them to obtain a standard shape would always be the same, and no feedback would be required; but in practice there are unavoidable variations in thickness of the masks. To compensate for these variations, force adjustments are necessary, and these are controlled by a feedback loop operated by a computer system connected to each clamp.

It has now been found that a different, simpler mask stretching process is also capable of achieving the goal of interchangeability. This process eliminates the need for a feedback control system. Thus, position-sensing apertures in the mask, optical markers and photosensors in the assembly machine are no longer needed. The concept of applying feedback-controlled forces to the mask edges, embodied in the apparatus and method taught by the '257 patent, is set aside, and the concept of imposing a predetermined fixed displacement upon the mask edges, regardless of the required forces, is put in its place.

Forces acting on an elastic body are related to the displacement of its boundaries by Hooke's law. So long as the elastic limit is not exceeded, the two are proportional to each other. It may therefore seem, at first glance, that there is no important difference between controlling force and controlling displacement. If all masks were exactly alike, this would indeed be true. It is the nature of the variations between masks actually encountered which makes the distinction between force and displacement important and renders the process according to this invention suitable for large-scale production of flat tension mask cathode ray tubes.

Tension masks for mass-produced cathode ray tubes are presently made of steel. Nickel-iron alloys such as molybdenum permalloy may be used instead because of their superior mechanical and magnetic properties; such masks are described in U.S. Pat. No. 4,900,976 assigned to the same assignee. Typically, tension masks are 1 mil (one-thousandth inch) thick. Manufacturing tolerance on the thickness is typically plus or minus 10%. Experience shows that there are small thickness variations—considerably less than 10%—within each mask, as well as within one production lot of masks. In addition, there are significant thickness variations between different production runs which show up as corresponding variations in mask stiffness.

The variations just discussed change the forces that must be applied to the mask to stretch it to the desired shape and size. Therefore if, for example, electric stepping motors are used to produce the required forces, and springs are inserted between motors and clamps to produce an adjustable force, as suggested in the '257 patent, rather than a controlled displacement, then masks from different production runs will require different numbers of motor steps. A thicker mask, for example, requires the stepping motor to stretch its spring further so as to produce the extra force required by the extra thickness. Similarly, a small thickness variation between top and bottom halves of the mask will require different forces to be applied to the top and bottom clamps along the vertical edges of the mask. Therefore, a feedback system to control the stepping motors as described in '257 becomes necessary.

Other patents cited as background in the art include: U.S. Pat. Nos. 4,942,333; 3,573,528; 4,555,034; and 4,748,370.

This invention arrives at the desired result—to stretch a mask to the desired size and shape, and position it correctly, by a different, more straightforward procedure. Taking advantage of the fact that the unstretched photoetched masks are very much alike except for minor variations in thickness, in a preferred arrangement to be described, the initial position of the mask upon insertion into the assembly machine can readily be defined with great precision by retractable alignment pins cooperating with photoetched apertures in the mask. Means for selectively gripping a mask edge, e.g. clamps similar to those shown in the '257 patent but having hard-surface jaws (no elastomeric coating) are precisely positioned before the jaws are closed. These clamps are connected to a motive means, e.g. stepping motors, by links which are as rigid as possible in the direction of the pulling force exerted upon the mask, so that a given or fixed displacement of each stepping motor is transferred unchanged from the motor to the corresponding clamp and thus to the mask edge.

With this arrangement, the stepping motors are programmed to advance by a predetermined number of steps after the clamps are closed, thereby producing a predetermined fixed displacement of the mask edge around the circumference of the mask and stretching the mask to a predetermined size and shape. Since the mask was initially correctly positioned by means of the alignment pins and since all displacements from that initial position are made in accordance with a predetermined data file, the stretched mask not only has the correct size and shape, but is also located at the correct position.

DESCRIPTIONS OF THE PREFERRED EMBODIMENTS

Figure 1:
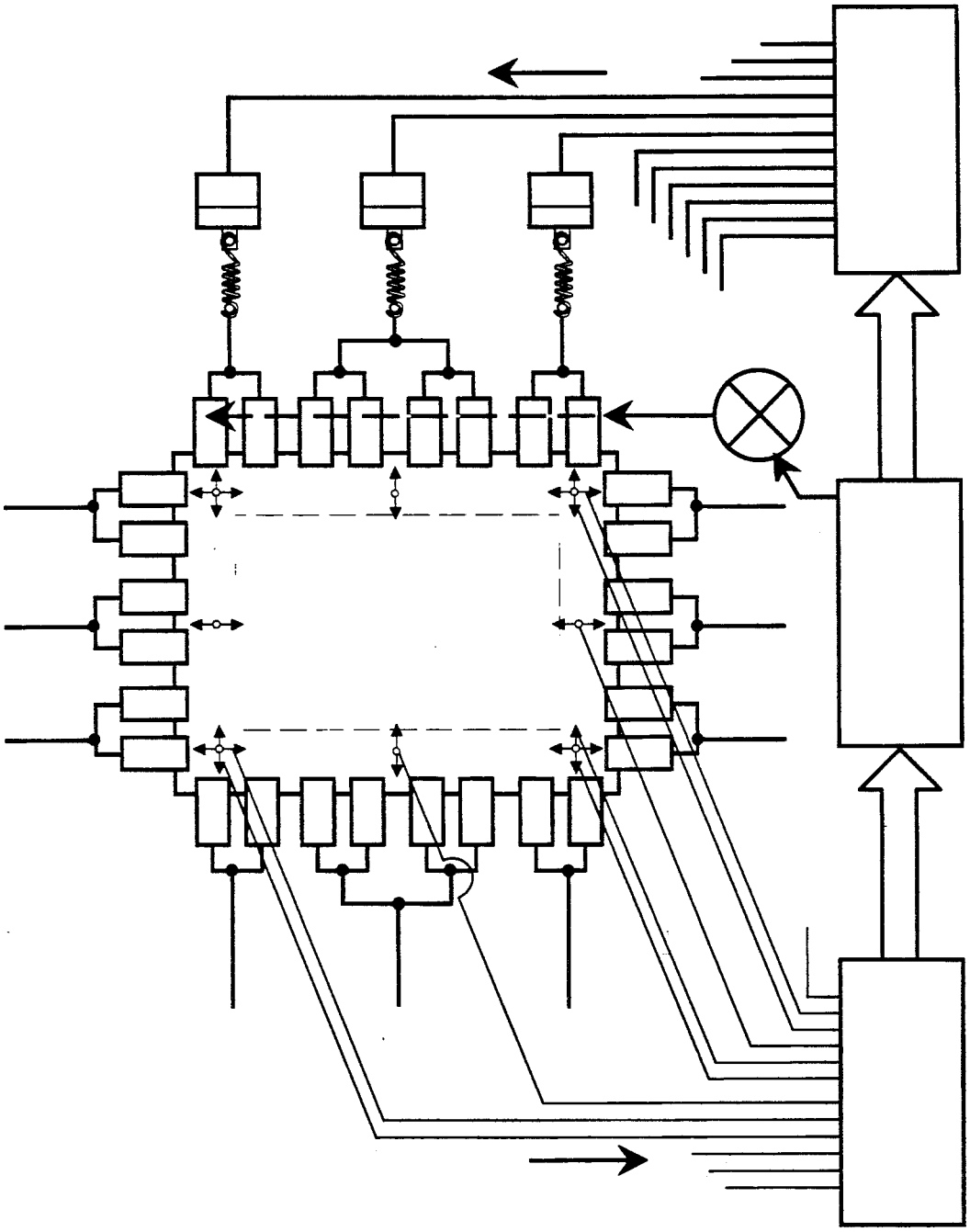
Fig. 1 (Prior Art)
FIG. 1 is an illustration of prior art flat tension mask stretching device.
Figure 2A:
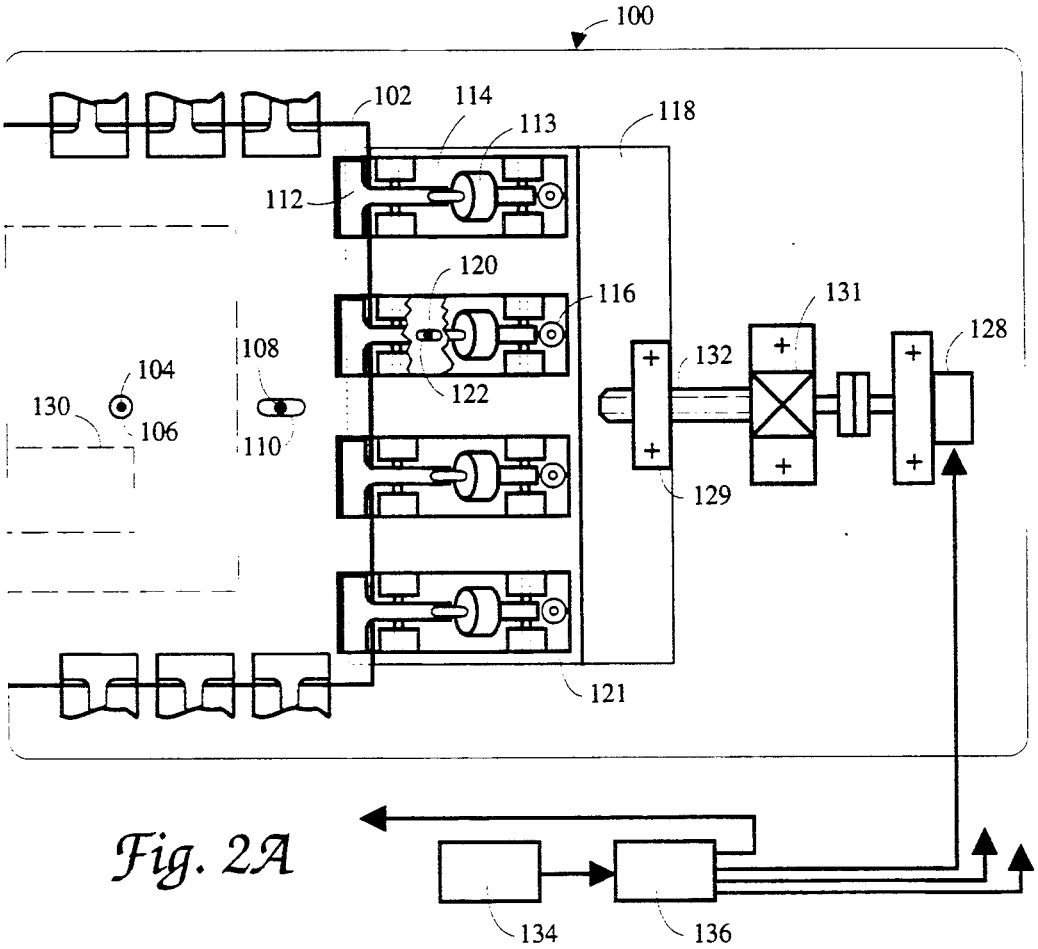
FIG. 2A is a top plan partial view of a first embodiment of a flat tension mask stretching device according to the present invention utilizing controlled displacement motive means.
Figure 2B:
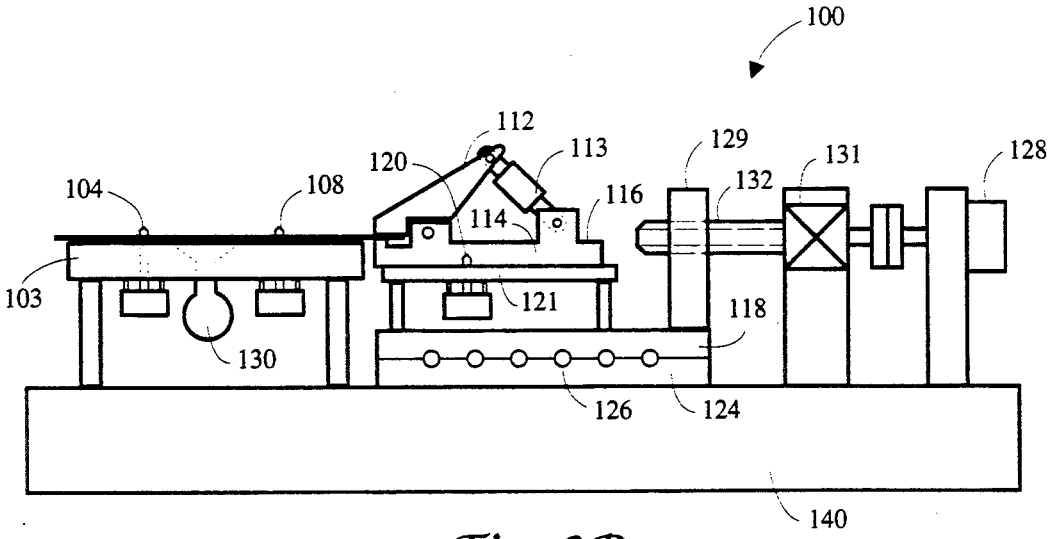
FIG. 2B is a side view of the embodiment of FIG. 2A.

FIGS. 2A and 2B schematically illustrate one form of apparatus 100 according to the invention. Mask 102 is placed on a flat table 103 equipped with precisely shaped alignment pins 104, 108 which are retractable into the table 103. The alignment pins 104, 108 mate with a round aperture 106 and a slot aperture 110, respectively, which are photoetched into the mask. The pins 104, 108 and apertures 106, 110 thereby determine the initial position of the mask.

Multiple clamps 112, located about the periphery of the mask 102, are powered to be opened or closed by air cylinders 113, or the like, attached thereto. As is known, a plurality of clamps is required along each of the four mask edges to allow for tangential stretching along that edge. As all four edge systems are substantially equivalent, the clamping arrangement for one edge will be described. The clamps 112 are individually mounted on long levers 114. The several levers 114 are mounted on a common lever plate 121 through pivots 116, allowing for lateral movement of the clamps 112. The lever plate 121 is, in turn, carried on a slide 118. Retractable pins 120 carried in the lever plate 121 cooperate with a slot 122 in each lever 114 to ensure lateral alignment of the levers before the clamps 112 close.

The slide 118 moves in a straight line along a precision guideway 124 equipped with roller bearings 126. The slide 118 is linked to a motive means, such as stepping motor 128, through a threaded post 129 and a lead screw 132, which is seated in a thrust bearing 131. Stepping motor 128 receives preprogrammed control pulses from a data file 134 through a power amplifier 136. Referring now to the whole apparatus 100, the table 103, guideways 124, thrust bearings 131 and stepping motors 128 are all mounted on a baseplate 140.

In operation, each mask edge stepping motor 128 is advanced sufficiently to pull the clamps 112 out of the way so that a mask 102 can be positioned on the table 103 over the alignment pins 104, 108. Optionally, a top plate (not shown) may be placed over the mask 102 to ensure flatness, or other means operable at ambient temperatures such as a vacuum pump 130 beneath the table 103 may be used for this purpose. Next, the stepping motor 128 is backed up to the desired starting point, with the clamps 112 guided by pins 120. The exact position of each clamp is fully defined by its pin 120, the length of its lever 114 and the position of slide 118 which in turn is controlled by stepping motor 128.

All clamps are then closed, preferably by pneumatic action of air cylinders 113, and the alignment pins 104, 108 and 120 are withdrawn. Each stepping motor 128 is then advanced by a predetermined increment to achieve a fixed displacement, stretching the mask 102 to the desired size and shape. In the process, levers 114 along each edge spread apart from each other by pivoting laterally at the pivot 116 by a small amount, typically in the order of one-thousandth of the dimensions of the active area of the mask, in order to accommodate stretching of the mask along the orthogonal axis.

Once the mask 102 is stretched, remaining manufacturing operations such as insertion and positioning of a screened faceplate equipped with a mask support structure, welding the mask to the support structure, cutting the mask along the outside of the support structure, extracting the faceplate-mask assembly, opening the clamps and removing the unused peripheral portion of the mask may be carried out as described in the aforementioned '257 patent.

The procedure just described presupposes that the screened faceplate which is to be joined to the stretched mask is correctly positioned, so that after welding the mask to the support structure mounted on the faceplate, mask and screen are properly registered. U.S. patent application Ser. No. 370,204, now U.S. Pat. No. 4,973,280, which is a continuation-in-part of the application now constituting the '257 patent, describes means and procedures for measuring the location of the screen pattern on the faceplate and for displacing the faceplate if need be so that the screen pattern is correctly positioned. The application also shows that it is not necessary for the mask to be correctly positioned, so long as it is stretched to the correct size and shape. Inspection means, for example optical devices, may then be used to determine the position of the mask, and appropriate corrections may be applied to the displacement of the faceplate so as to compensate for the original position errors of the mask as well as the screen.

This same principle may be applied to the present invention. Accordingly, it is not necessary for the mask to be placed with extreme accuracy in position for registration with the screened faceplate before the clamps close; an original positioning error may later be compensated by the procedure just described. This possibility is important if the mask, for example, is extremely thin (for example, less than 0.001") so that positioning by tightly fitting registration pins could warp or tear it.

It will be understood that the essence of the invention is to stretch a mask by a fixed displacement to a predetermined size and shape by displacing a plurality of points on its periphery outward by predetermined increments. This may be done not only by means of the apparatus described in FIGS. 2A and 2B, but also in other ways.

Figure 3A:
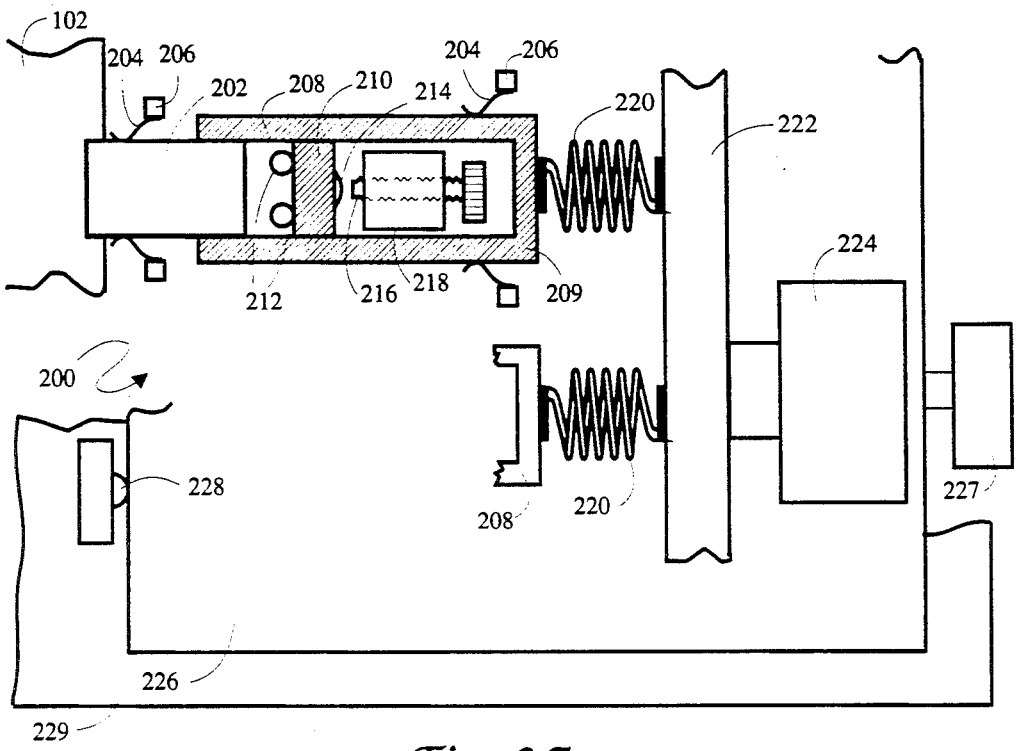
FIG. 3A is top view of an alternative embodiment of a device according to the present invention utilizing mechanical stops to control mask displacement.
Figure 3B:
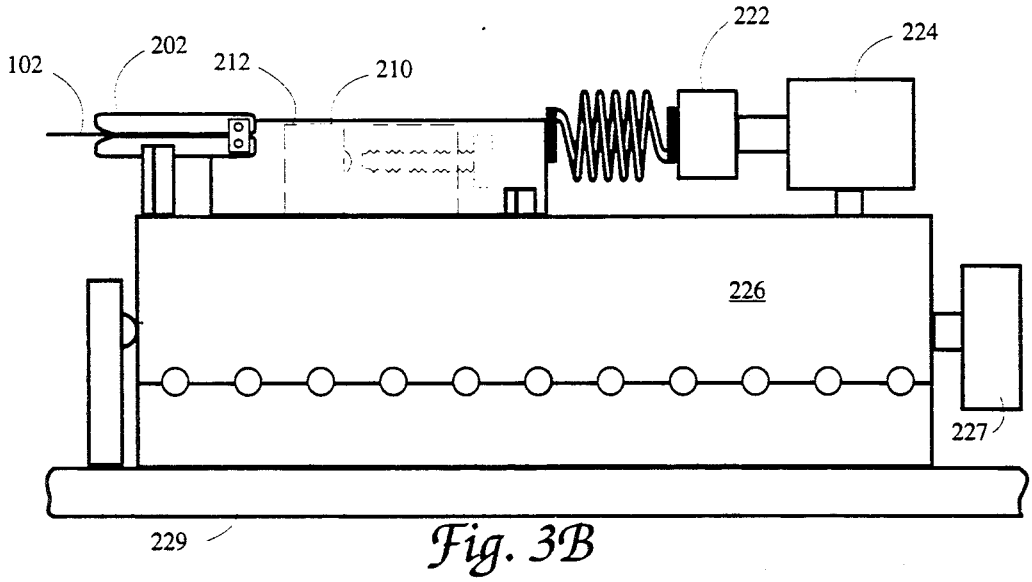
FIG. 3B is a side view of FIG. 3A.

FIGS. 3A and 3B illustrate schematically an alternative fixed displacement mask-stretcher. Only the mechanism 200 associated with one clamp 202 is described in detail, it being understood that any desired number of clamps may be used, equipped with similar mechanisms.

The mechanism 200 described hereinafter is supported by a movable carrier plate 226 which serves to move the mechanism 200 out of the way for mask insertion. One such carrier plate 226 is used for each of the four mask edges. FIGS. 3A and 3B show part of the carrier plate 226 serving the right vertical edge of the mask 102. At all times except during mask insertion and during removal of the unused peripheral portion of the mask at the end of the process, i.e. when the mechanism is in the mask loading position, the carrier plate 226 is pressed by carrier plate driver 227 firmly against stops 228 which are mounted on the main frame 229 of the assembly machine. This latter position is denominated as the "operational position" of the mechanism 200.

A clamp 202 is laterally guided on either side thereof by leaf springs 204 which in turn are attached to posts 206 mounted on carrier plate 226. The leaf springs 204 ensure correct lateral placement of the clamp 202 when the clamp is open, but permit the small lateral movement which occurs when the clamp is closed and the mask is being stretched.

Attached to the clamp 202 is a "U"-shaped rigid frame 208 which carries therein a bar 210. In the rest position of the clamp, the bar 210 is pushed firmly against pins 212 which are mounted interiorly of the rigid frame 208 on carrier plate 226. The pushing is accomplished by the action of a resilient link, or spring 220, then under compression, attached to the bight 209 of each frame. All springs 220 associated with one edge of the mask are connected to a common yoke 222 which is attached to a driver, such as pneumatic driver 224, the latter also mounted on the carrier plate 226.

In the following description, the terms "right" and "left", used for greater clarity, refer specifically to FIGS. 3A and 3B, which show mechanism 200 located to the right of the mask 102. It will be understood that more generally, "right" means "away from the mask" and "left" means "toward the mask."

When the pneumatic driver 224 is activated, yoke 222 is pulled to the right. The spring 220 is stretched, and instead of pushing the clamp 202 to the left as before, it now pulls the clamp to the right, stretching the mask. However, the displacement of the clamp 220 is limited by a hard physical barrier, such as an adjustable stop 216 which is comprised of a micrometric screw 217 set into a block 218 which is mounted on the carrier plate 226. The screw 217 makes contact with a half-ball 214 which is attached to the bar 210 on its right side. The setting of the stop 216, and not the spring force, thus determines the displacement of each clamp. Each spring 220 must be stiff enough to produce the force required for stretching the mask with a reasonable displacement of the pneumatic driver 224. However, there is no need for precisely adjusted spring constants or for precisely defined displacement of the pneumatic driver. All the required precision is lodged in the setting of the adjustable stop 216.

In operation, carrier plate 226 is moved to the right by carrier plate driver 227 to displace the entire mechanism 200 by an amount sufficient to permit inserting a mask, i.e., into the mask loading position. During this time, the clamps 202 are open and in their rest position, i.e., the bars 210 make firm contact with the pins 212. The mask is positioned by means of retractable alignment pins such as described in connection with FIGS. 2A & 2B. Once the mask is in place, the carrier plate 226 is moved back to the left and pressed firmly against the stops 228, i.e., into its operational position. It will be noted that because the carrier plate 226 is moved only when the clamps 202 are open, very little force is required to move it.

The clamps 202 are now closed, the mask alignment pins withdrawn and the pneumatic drivers 224 (one for each mask edge) activated. All clamps move until the half balls 214 are seated against their respective stops 216. The mask is thereby stretched to the correct size and shape, and it is in the correct position; welding and cutting may now be done as previously described. Finally, the clamps 202 are opened, the pneumatic drivers 224 are de-activated and carrier plates 226 are moved away from the mask to permit easier removal of the peripheral portion of the mask. The machine is then ready to accept a new mask.

The details and the timing of faceplate insertion and removal of the completed faceplate-mask assembly have not been described here. They do not form part of this invention and may be carried out in any convenient manner.

The form of the invention just described has the advantage that only four mechanical drivers are required, regardless of the number of points along the edges whose displacements one wishes to specify; and even those four drivers, one for each edge, may be relatively crude pneumatic drivers rather than precisely made, computer-driven stepping motors. The required precision is attained by accurately fixing the displacement of each clamp by means of mechanical stops such as pins 212 and adjustable stops 216.

Figure 4A:
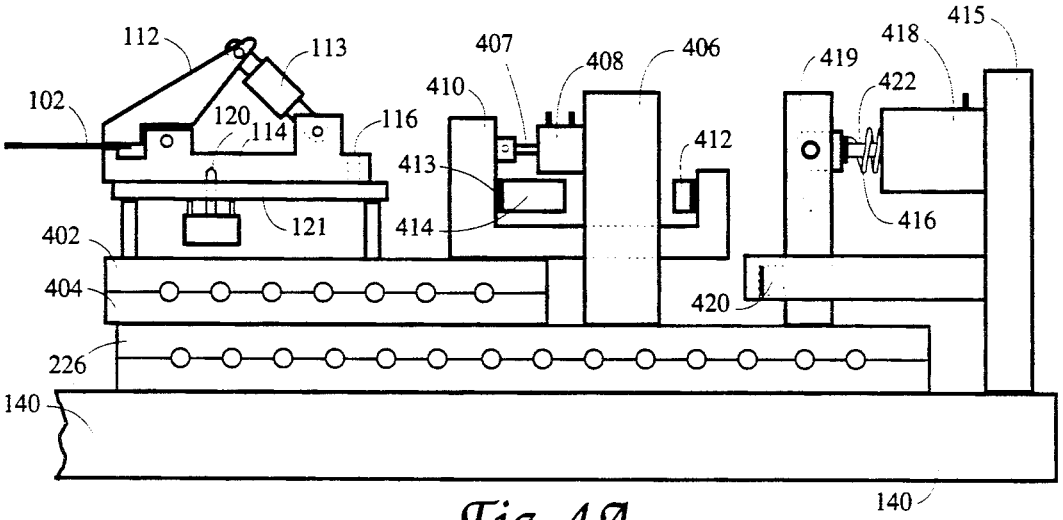
FIG. 4A is a side view of an alternate embodiment of a device according to the present invention utilizing mechanical stops to control the mask displacement.
Figure 4B:
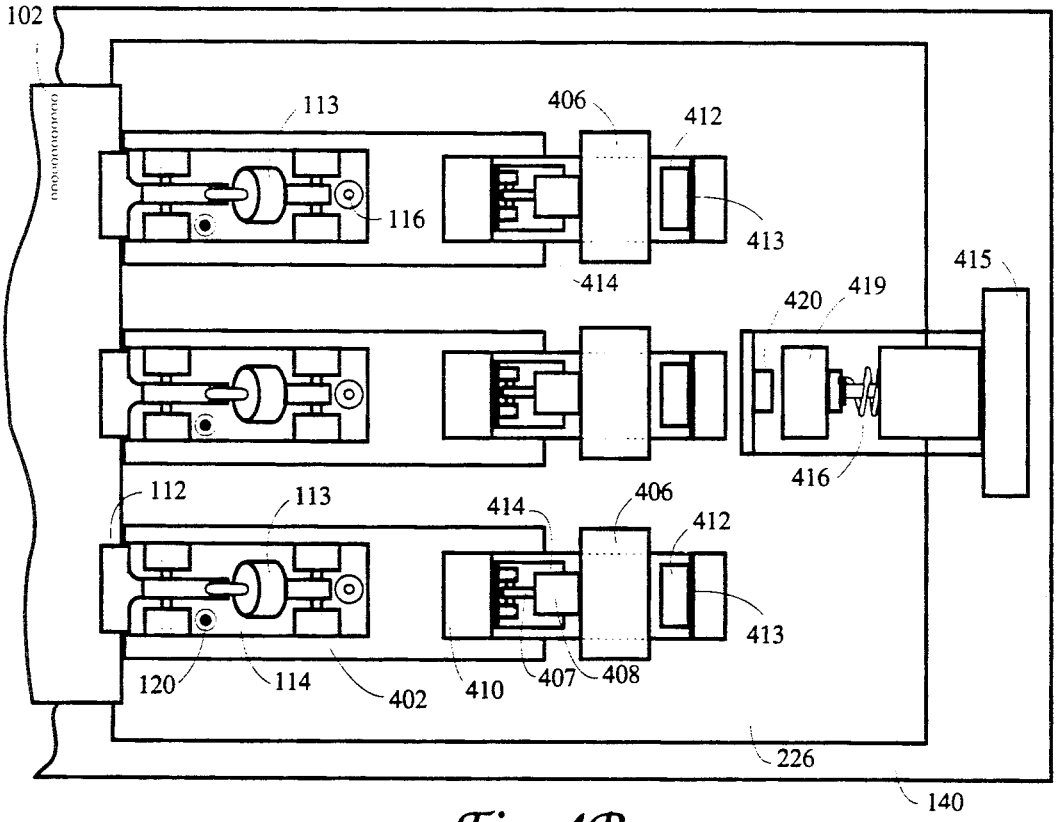
FIG. 4B is a top view of FIG. 4A.

FIGS. 4A & 4B show an alternative form embodying the same principle as FIGS. 3A and 3B. As in FIGS. 3A & 3B, only the mechanism serving the right side of the mask 102 is illustrated, it being understood that similar mechanisms serve the other three sides. Again, "right" and "left" mean more generally "away from the mask" and "toward the mask" respectively. In FIGS. 4A & 4B each mask clamp 112 is independently driven during operation rather than being connected to a common yoke or carrier, as further explained below. Clamps 112, with levers 114 attached to platforms, or lever plates 121, through pivots 116; function as described in connection with FIGS. 2A and 2B. Before clamping, the lateral position of levers 114 are standardized by retractable alignment pins 120.

Lever plates 121 are mounted on slides 402. Each slide 402 thus carries one clamp 112 independent of the other clamps. The bases 404 of these slides are themselves fastened to a common, movable carrier plate 226. The common carrier plate 226 is slidably mounted on a fixed base 140. The carrier plate 226 also supports several first posts 406, each first post 406 being proximal to its associated slide 402. Attached to slide 402 is a "U"-shaped plate control structure 410. A double-acting air cylinder 408 mounted to each post 406, and attached to the plate control structure 410 through a piston rod 407, drives the plate control structure 410 to the left or right as desired. Motion to the left or right is limited by stops 412, 414, respectively, which are affixed to the arms of the plate control structure 410. All stops 412, 414 may be adjusted, for example, by means of shims 413, to independently control the movement of each clamp 112, as further explained below.

Attached to the fixed base 140 at the right end, is a single second post 415. A single third post 419, intermediately placed between the first and second posts is mounted on the movable carrier plate 226.

The carrier plate 226 may be moved to the right by a distance sufficient to permit mask insertion as well as the removal of a finished mask-faceplate assembly. A return spring 416 connected between the second and third posts 415, 419 respectively, provides the small required force for this movement. Once a new mask 102 is in place but before the clamps 112 are closed, an air cylinder 418, attached to the 2nd post 415 and to the 3rd post 419 through a piston rod 422, is activated and moves carrier plate 226 to the left to a position determined by a stop 420. The stop 420 is cantilevered from the second post 415 at a point intermediate the first and second posts 406, 419 respectively. The double acting air cylinders 408 then move the slides 402 to the left against their respective stops 412. Next, air cylinders 113 are activated to close the clamps 112 onto the mask 102. The air supply to each air cylinder 408 is then reversed to pull the slides 402 to the right against their respective stops 414, thereby stretching the mask 102.

While the operation of only one carrier plate 226 has been described, it will be understood that in practice there is one carrier plate 226 and one air cylinder 418 for each of the four sides of the mask, and there is one slide 402, one plate 121, one post 406, one double action air cylinder 408, and one plate control structure 410 for each of the several clamps 112 on each side of the mask 102.

The embodiment just described shares with the one described in connection with FIGS. 3A and B the advantage that the displacement of each clamp 112, and thus the displacement of the corresponding portions of the mask edge, may be individually fixed by adjusting the setting of stops 216 (FIGS. 3A and B) and stops 412 and/or 414 (FIGS. 4A and B). The last described embodiment has the further advantage that none of the drivers—in this case, air cylinders 408—need produce a larger force than what is required for a single clamp. The sum of the forces acting on all clamps along one mask edge, typically amounting to several hundred pounds, is exerted against stop 420 but need not be generated by any single driver.

Figure 5:
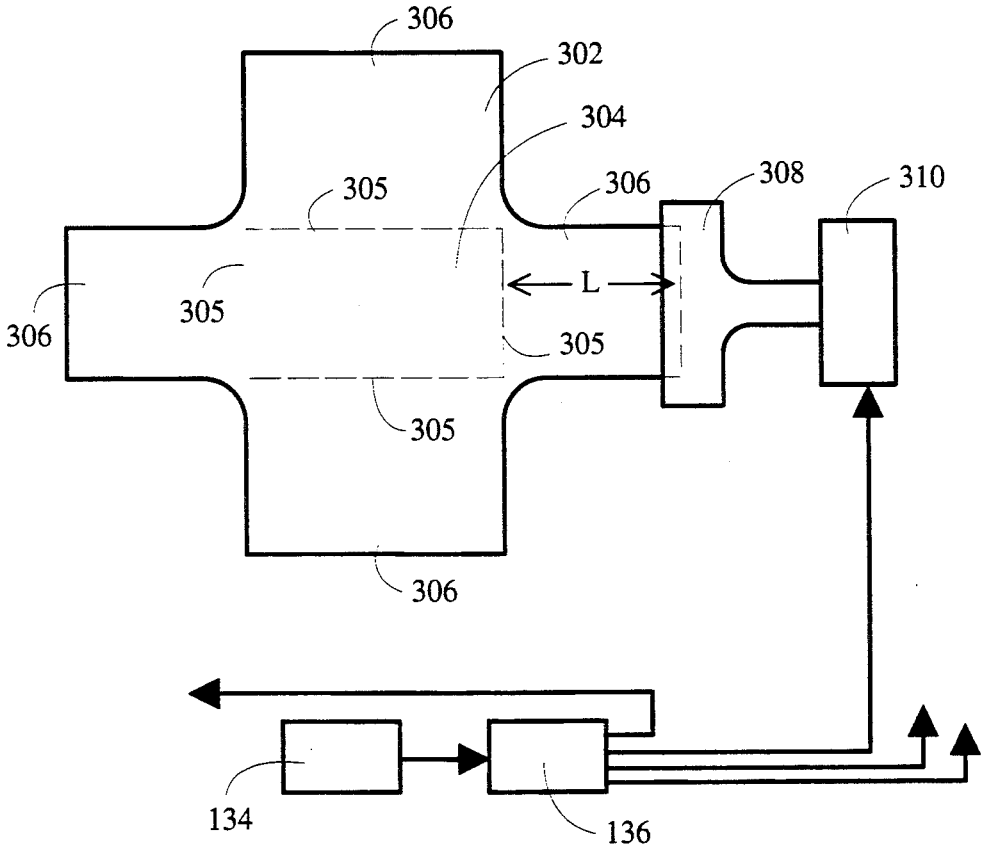
FIG. 5 is alternative embodiment of a device according to the present invention utilized with masks having extended edge portions.

The need for a plurality of clamps along each edge arises, as previously explained, because each edge must be free to stretch as the entire mask is stretched. It is possible, however, to use just one broad clamp along each edge if the clamps are sufficiently far away from the central, apertured portion of the mask. FIG. 5 illustrates such an arrangement.

As seen in FIG. 5, mask 302 has a central apertured portion 304 and four appendages 306. The appendages are of sufficient length L to permit the edges 305 of the apertured portion 304 to stretch even though the outer edges of appendages 306 are clamped, without producing excessive stress in the mask material. If desired, portions of appendages 306 may be perforated in order to improve the stress distribution.

A clamp 308 is attached to each appendage 306 and to a stepping motor 310. Operation of this embodiment is the same as that described in connection with FIG. 2A and 2B. It will be seen that the mechanisms described in connection with FIGS. 3A and B and 4A and B, with the displacement of the clamps controlled by mechanical stops, may be substituted for stepping motors 310 whose displacement is controlled by a data file 134 through the power amplifier 136.

It will be understood that in a machine constructed according to FIG. 5, control over the size and shape of the apertured portion 304 is not as close as with machines built according to FIGS. 2A, 2B, 3A, 3B and 4A &B. Appendages 306, made long enough in dimension L to permit transverse stretching of the aperture portion edges 305 are also long enough to permit certain geometrical distortions to occur. These distortions, however, are generally the same with each mask and thus are of little consequence.

It is further understood that a machine according to FIG. 5 wastes a larger percentage of mask material than the machines shown in the earlier figures. However, a machine constructed according to FIG. 5 has the important advantage of low complexity, e.g.. absence of pivots, retractable pins, springs, etc., resulting in less down time and reduced maintenance, yet is capable of stretching masks with high uniformity provided that the unstretched masks are sufficiently uniform.

While the present invention has been illustrated and described in connection with the preferred embodiments, it is not to be limited to the particular structure shown, because many variations thereof will be evident to one skilled in the art and are intended to be encompassed in the present invention as set forth in the following claims.

What is claimed is:

1. A CRT shadow mask stretching apparatus comprising:

a) clamping means constructed and arranged for selectively gripping a thin metal foil shadow mask edge and;

b) means for moving the clamping means through a predetermined fixed displacement; so as to obtain a tensioned shadow mask of the correct size and shape for registration and assembly with a CRT phosphor screen, the size and shape being repeatable for like ones of a series of masks.

2. A CRT shadow mask stretching apparatus comprising:

a) clamping means constructed and arranged for selectively gripping a thin metal foil shadow mask edge;

b) motive means for moving the clamping means through a substantially translational movement along a major axis of the mask; and, c) means for limiting the translational movement of the clamping means to a predetermined fixed displacement;

so as to obtain a tensioned shadow mask of the correct size and shape for registration and assembly with a CRT phosphor screen, the size and shape being repeatable for like ones of a series of masks.

3. A CRT shadow mask stretching apparatus comprising:

a) clamping means constructed and arranged for selectively gripping a thin metal foil shadow mask edge;

b) means for moving the clamping means through a predetermined fixed displacement; and c) means for adjusting the predetermined fixed displacement of the clamping means;

so as to obtain a tensioned shadow mask of the correct size and shape for registration and assembly with a CRT phosphor screen, the size and shape being repeatable for like ones of a series of masks.

4. A flat tension mask stretching apparatus comprising:

a) means for selectively gripping a mask edge;

b) motion means for moving the gripping means through a substantially translational displacement along a major axis of the mask;

c) means for limiting the translational displacement of the gripping means to a predetermined fixed amount; and, d) means for positioning the mask before the gripping means grip the mask edge.

5. A CRT shadow mask stretching apparatus comprising:

a) clamping means constructed and arranged for gripping a thin metal foil shadow mask edge;

b) motive means for moving the clamping means through a translational displacement along a major axis of the mask, c) means for limiting the translational displacement of the clamping means to a predetermined fixed amount.

d) means for allowing movement of the clamping means laterally to a strictly translational movement;

so as to obtain a tensioned shadow mask of the correct size and shape for registration and assembly with a CRT phosphor screen, the size and shape being repeatable for like ones of a series of masks.

6. A flat tension mask stretching apparatus comprising:

a) means for selectively gripping a mask edge;

b) motive means for moving the gripping means through a substantially translational displacement along a major axis of the mask;

c) means for limiting the translational displacement of the gripping means to a predetermined fixed amount; and d) retractable pins for engaging apertures in the mask to fix the position thereof before stretching the mask.

7. A flat tension mask stretching apparatus comprising:

a) means for selectively gripping a mask edge;

b) motive means for moving the gripping means through a substantially translational displacement along a major axis of the mask;

c) means for limiting the translational displacement of the gripping means to a predetermined fixed amount; and, d) means for flattening the mask into a substantially single plane before the gripping means grip the mask.

8. A CRT shadow mask stretching apparatus comprising:

a) clamping means constructed and arranged for selectively gripping a thin metal foil shadow mask edge;

b) motive means for moving the clamping means through a substantially translational displacement along a major axis of the mask; and c) physical barriers for limiting the translational displacement of the means to a predetermined fixed amount; so as to obtain a tensioned shadow mask of the correct size and shape for registration and assembly with a CRT phosphor screen, the size and shape being repeatable for like ones of a series of masks.

9. A CRT shadow mask stretching apparatus comprising:

a) clamping means constructed and arranged for selectively gripping a thin metal foil shadow mask edge;

b) motive means for moving the clamping means through a substantially translational displacement along a major axis of the mask; and, c) control means operatively engaged with the motive means for limiting the translational displacement of the motive means to a predetermined fixed amount; so as to obtain a tensioned shadow mask of the correct size and shape for registration and assembly with a CRT phosphor screen, the size and shape being repeatable for like ones of a series of masks.

10. A CRT shadow mask stretching apparatus comprising:

a) clamping means constructed and arranged for selectively gripping a thin metal foil shadow mask edge; and b) means for moving the clamping means through a predetermined fixed displacement, the moving means including a stepping motor and a controlled power supply to the motor; so as to obtain a tensioned mask of the correct size and shape for registration and assembly with a CRT phosphor screen, the size and shape being repeatable for like ones of a series of masks.

11. A CRT shadow mask stretching apparatus comprising:

a) clamping means constructed and arranged for selectively gripping a thin metal foil shadow mask edge;

b) a fluid driven means for moving the clamping means through a substantially translational displacement along a major axis of the mask; and, c) adjustably positonable physical barriers for limiting the translational displacement of the clamping means to a predetermined fixed amount;

so as to obtain a tensioned shadow mask of the correct size and shape for registration and assembly with a CRT phosphor screen, the size and shape being repeatable for like ones of a series of masks.

12. A flat tension mask stretching apparatus comprising:

a) means for selectively gripping a mask edge;

b) motive means for moving the gripping means through a substantially translational displacement along a major axis of the mask;

c) means for limiting the translational displacement of the gripping means to a predetermined fixed amount; and, d) retractable pins for engaging apertures in the mask to fix the position thereof before stretching the mask.

13. A flat tension mask stretching apparatus comprising:

a) clamps for selectively gripping a mask edge;

b) motive means for moving the clamps through a substantially translational displacement along a major axis of the mask;

c) means for limiting the translational displacement of the clamps to a predetermined fixed amount; and, d) means for allowing the clamps to move outwardly from each other during translational movement.

14. A flat tension mask stretching apparatus comprising:

a) clamps for selectively gripping a mask edge;

b) individual motive means associated with each clamp for moving the clamps through a substantially translational displacement along a major axis of the mask;

c) means associated with each individual motive means for limiting the translational displacement of the clamps to a predetermined fixed amount.

15. The apparatus according to claim 14 further comprising means for collectively moving the clamps between an operational position and a mask loading position.

16. A CRT shadow mask stretching apparatus comprising:

a) clamps constructed and arranged for selectively gripping a thin metal foil shadow mask edge;

b) motive means for collectively moving the clamps through a substantially translational displacement along a major axis of the mask; and, c) physical barriers for limiting the individual translational displacement of each clamp to a predetermined fixed amount;

so as to obtain a tensioned shadow mask of the correct size and shape for registration and assembly with a CRT phosphor screen, the size and shape being repeatable for like ones of a series of masks.

17. The apparatus according to claim 16 further comprising means for collectively moving the clamps between a mask loading position and an operational position.

18. A CRT shadow mask stretching apparatus comprising:

a) clamps constructed and arranged for selectively gripping a thin metal foil shadow mask edge;

b) a carrier plate for collectively moving the clamps through a substantially translational displacement along a major axis of the mask; and, c) control means operatively engaged with the motive means for limiting the translational displacement of the clamps to a predetermined fixed amount;

so as to obtain a tensioned shadow mask of the correct size and shape for registration and assembly with a CRT phosphor screen, the size and shape being repeatable for like ones of a series of masks.

19. A flat tension mask stretching apparatus comprising:

a) clamps for selectively gripping a mask edge;

b) motive means for moving the clamps through a substantially translational fixed displacement along a major access of the masks; and, c) means for a laterally aligning all clamps operating on one mask edge before attachment of the clamps to the mask edge.

20. The apparatus according to claim 19 wherein the means for a lateral alignment further comprises:

a) apertures within the clamps; and, b) retractable alignment pins for engaging the apertures to laterally align the clamps.

21. The apparatus according to claim 19 wherein the means for lateral alignment further comprises:

resilient leaf springs contacting the clamps.

* * * * *